US006590326B2

(12) United States Patent
Diven et al.

(10) Patent No.: US 6,590,326 B2
(45) Date of Patent: Jul. 8, 2003

(54) APPARATUS FOR MAINTAINING TENSION IN A SHADOW MASK

(75) Inventors: Gary Lee Diven, Lancaster, PA (US); Joseph Arthur Reed, York, PA (US)

(73) Assignee: Thomson Licensing S. A., Boulogne Cedex (FR)

( * ) Notice: Subject to any disclaimer, the term of this patent is extended or adjusted under 35 U.S.C. 154(b) by 156 days.

(21) Appl. No.: 09/742,617

(22) Filed: Dec. 21, 2000

(65) Prior Publication Data

US 2002/0079809 A1 Jun. 27, 2002

(51) Int. Cl.[7] ..... H01J 29/80

(52) U.S. Cl. ..... 313/402; 313/407

(58) Field of Search ..... 313/402, 407, 313/408, 403, 364, 415; 315/3, 5.23

(56) References Cited

U.S. PATENT DOCUMENTS

| | | | | | |
|---|---|---|---|---|---|
| 4,437,036 | A | * | 3/1984 | Ragland, Jr. | 313/402 |
| 5,850,121 | A | * | 12/1998 | Matsudate | 313/402 |
| 6,396,203 | B1 | * | 5/2002 | Aibara et al. | 313/402 |
| 6,411,024 | B1 | * | 6/2002 | Arimoto | 313/402 |
| 6,417,608 | B1 | * | 7/2002 | Choi et al. | 312/402 |

* cited by examiner

*Primary Examiner*—Don Wong
*Assistant Examiner*—Minh D A
(74) *Attorney, Agent, or Firm*—Joseph S. Tripoli; Joseph J. Laks; Carlos M. Herrera

(57) ABSTRACT

An apparatus for maintaining tension in a mask frame of a cathode ray tube. The apparatus includes affixing a shadow mask to a pair of triboxes disposed along opposite sides of a mask frame at a predetermined tension. The triboxes are coupled to the mask frame by braces having a different coefficient of thermal expansion than the triboxes so as to compensate for the expansion of the frame during thermal cycling of the cathode ray tube. Consequently, it is possible to maintain the tension force applied to the shadow mask by the mask frame.

14 Claims, 3 Drawing Sheets

APPARATUS FOR MAINTAINING TENSION IN A SHADOW MASK

This invention generally relates to color picture tubes and, more particularly, to an apparatus for maintaining tension in a shadow mask of a cathode ray tube.

BACKGROUND OF THE INVENTION

A conventional color picture tube includes an electron gun for generating and directing three electron beams to the screen of the tube. The screen is located on the inner surface of the faceplate of the tube and is made up of an array of elements of three different color-emitting phosphors. A color selection electrode, also referred to as a shadow mask, is interposed between the gun and the screen to permit each electron beam to strike only the phosphor elements associated with that beam. A shadow mask is a thin sheet of metal, such as steel, that is usually contoured to somewhat parallel the inner surface of the tube faceplate.

One type of color picture tube shadow mask is a tension mask mounted within a faceplate panel thereof. In order to maintain the tension on the mask, the mask must be attached to a relatively massive support frame. Although such tubes have found wide consumer acceptance, there is still a need for further improvement, to reduce the weight and cost of the mask-frame assemblies in such tubes.

It has been suggested that a lighter frame could be used in a tension mask tube if the required tension on a mask is reduced. One way to reduce the required mask tension is to make the mask from a material having a low coefficient of thermal expansion. However, a mask from such material requires a support frame of a material having a similar coefficient of thermal expansion, to prevent any mismatch of expansions during thermal processing that is required for tube manufacturing, and during tube operation. Because the metal materials that have low coefficients of thermal expansion are relatively expensive, it is costly to make both the mask and frame out of identical or similar low expansion materials. Therefore, it is desirable to use the combination of a low expansion tension mask with a higher expansion support frame, and to provide a solution to the problem that exists when there is substantial mismatch in coefficients of thermal expansion between a tension mask and its support frame.

SUMMARY OF THE INVENTION

The present invention provides an apparatus for maintaining tension in a shadow mask. The invention compensates for the thermal expansion mismatch between a low expansion material such as INVAR® which is an alloy chiefly composed of Ni and Fe, and a high expansion material such as steel used in the tension mask and the mask frame, respectively. The need to maintain tension in a tension mask is essential to the correct operation of the cathode ray tube in a color television.

In the present invention, the mask frame has a generally rectangular plan form with two long sides and two short sides. A corner support structure incorporating a standoff is attached to each end of each short side. Atop the standoffs is welded the long side member comprised of a triangular shaped cross-section support structures referred to herein as triboxes. The first side (leg) of the triangular triboxes are attached to the standoff and the hypotenuse faces inwardly of the mask frame. The second side (leg) of the triangular triboxes is affixed to a side of a low expansion material, such as INVAR®, blade. The blade is vertically oriented and the top of the blade supports an INVAR® mask. Attached between the short side steel mask frame and the steel triboxes is a brace formed of a low expansion material such as INVAR®. The thermal expansion mismatch and geometric separation between the low coefficient of thermal expansion brace and the steel short side of the mask frame causes the steel tribox to rotate about its stand-off when heated. The brace is sized such that the inward rotation of the tribox compensates for the expansion of the frame, thereby preserving the tension in the mask that is supported by the blade as the frame is heated. This system is specifically designed to maintain tension in the shadow mask during thermal cycling of the mask frame assembly such that uniform creep of the mask occurs and mask wrinkles caused by differential mask creep are eliminated.

DETAILED DESCRIPTION

Figure 1:
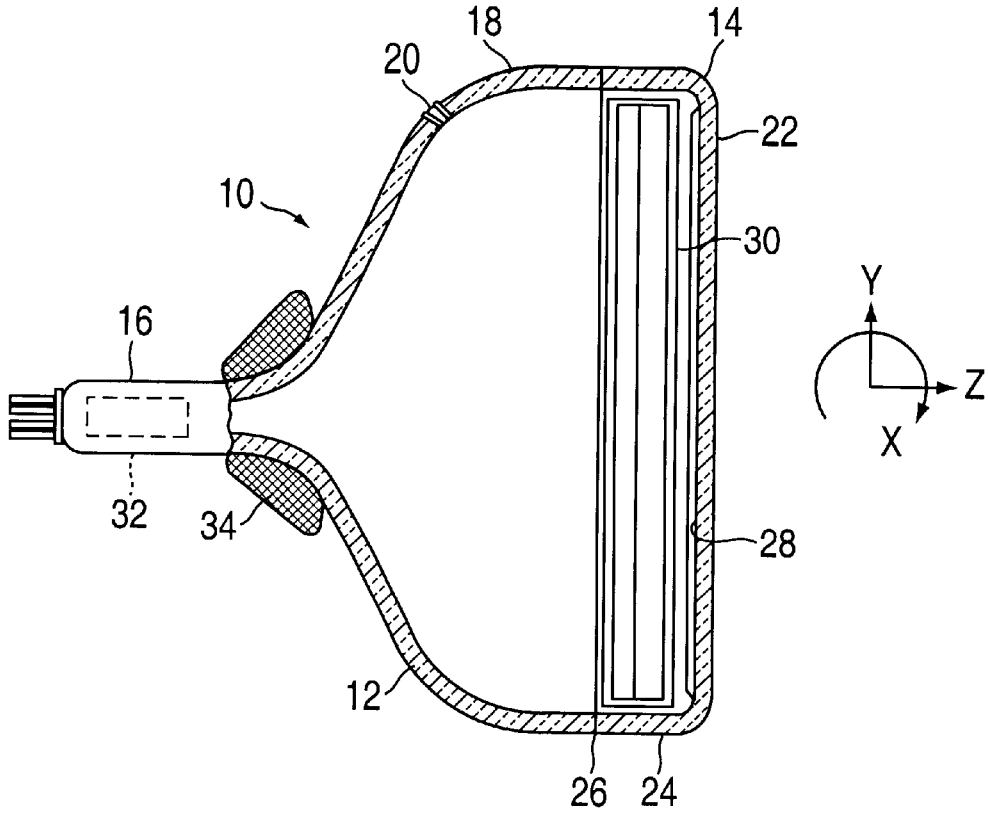
FIG. 1 is a side view, partly in the axial section, of a color picture tube, including a tension mask-frame-assembly according to the present invention.
Figure 2:
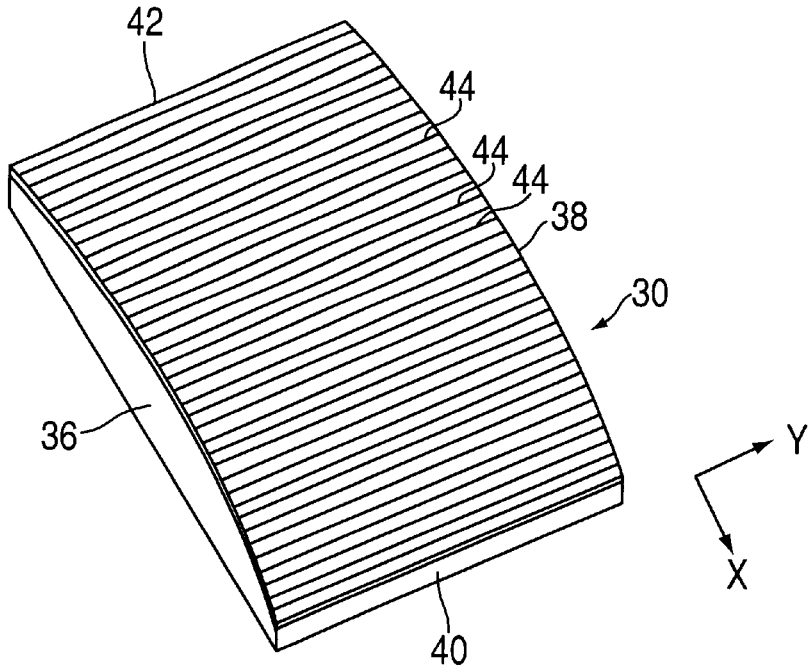
FIG. 2 is a perspective view of a tension mask of FIG. 1.

FIG. 1 shows a cathode ray tube 10 having a glass envelope 12 comprising a rectangular faceplate panel 14 and a tubular neck 16 connected by a rectangular funnel 18. The funnel 18 has an internal conductive coating (not shown) that extends from an anode button 20 to a neck 16. The panel 14 comprises a viewing surface 22 and a peripheral flange or sidewall 24 that is sealed to the funnel 18 by a glass frit 26. A three-color phosphor screen 28 is carried by the inner surface of the faceplate panel 14. The screen 28 is a line screen with the phosphor lines arranged in triads, each triad including a phosphor line of each of the three primary colors. A tension mask 30 is removably mounted in a predetermined spaced relation to the screen 28. The mask may be either a tension focus mask (not shown) or a tension mask (as generally illustrated in FIG. 2). An electron gun 32 (schematically shown by the dashed lines in FIG. 1) is centrally mounted within the neck 16 to generate three inline electron beams, a center beam and two side beams, along convergent paths through the tension mask 30 to the screen 28.

The tube 10 is designed to be used with an external magnetic deflection yoke, such as the yoke 34 shown in the neighborhood of the funnel to neck junction. When activated, the yoke 34 subjects the three beams to magnetic fields that cause the beams to scan horizontally and vertically in a rectangular raster over the screen 28.

The tension mask 30, shown in greater detail in FIG. 2, includes two long sides 36 and 38 and two short sides 40 and 42. The two long sides 36 and 38 of the tension mask 30 parallel a central major axis, x, of the tube, and the two short sides 40 and 42 parallel a central minor axis, Y, of the tube. The tension mask 30 includes an apertured portion that contains a plurality of metal strips or stands 44 having a multiplicity of elongated slits therebetween that parallel the minor axis of the mask.

Figure 3:
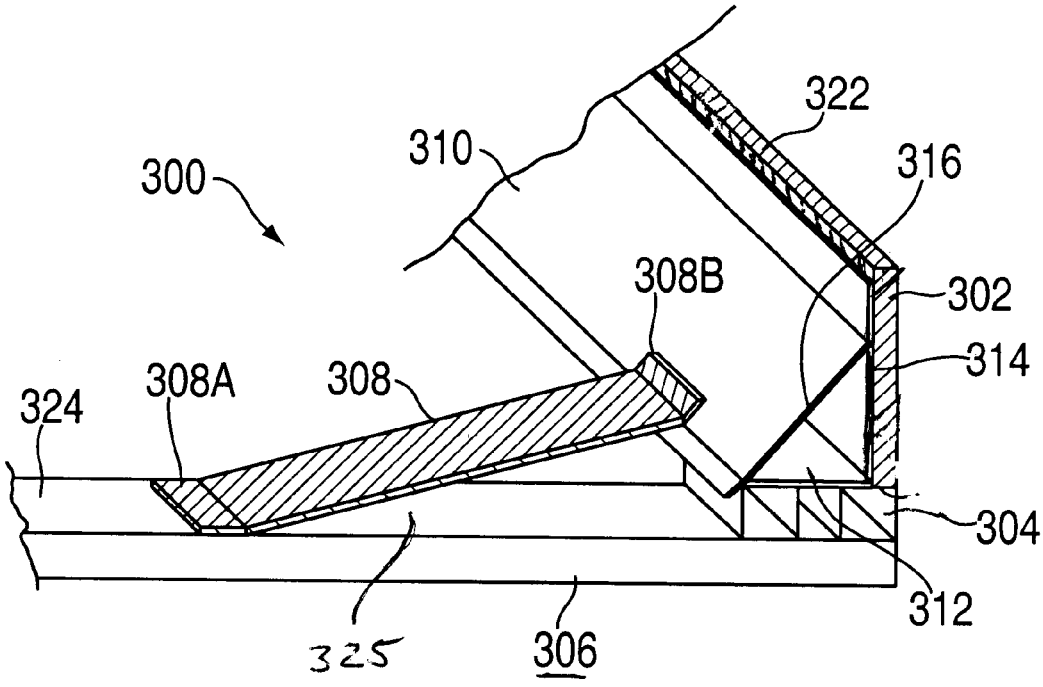
FIG. 3 is a partial perspective view of a section of the mask-frame assembly according to the present invention.

FIG. 3 depicts a partial perspective view of the mask frame assembly 300 of the present invention that supports the tension mask 30 of FIG. 2. The portion of the assembly 300 depicted in FIG. 3 is repeated on all four corners of the mask frame assembly 300.

Figure 4:
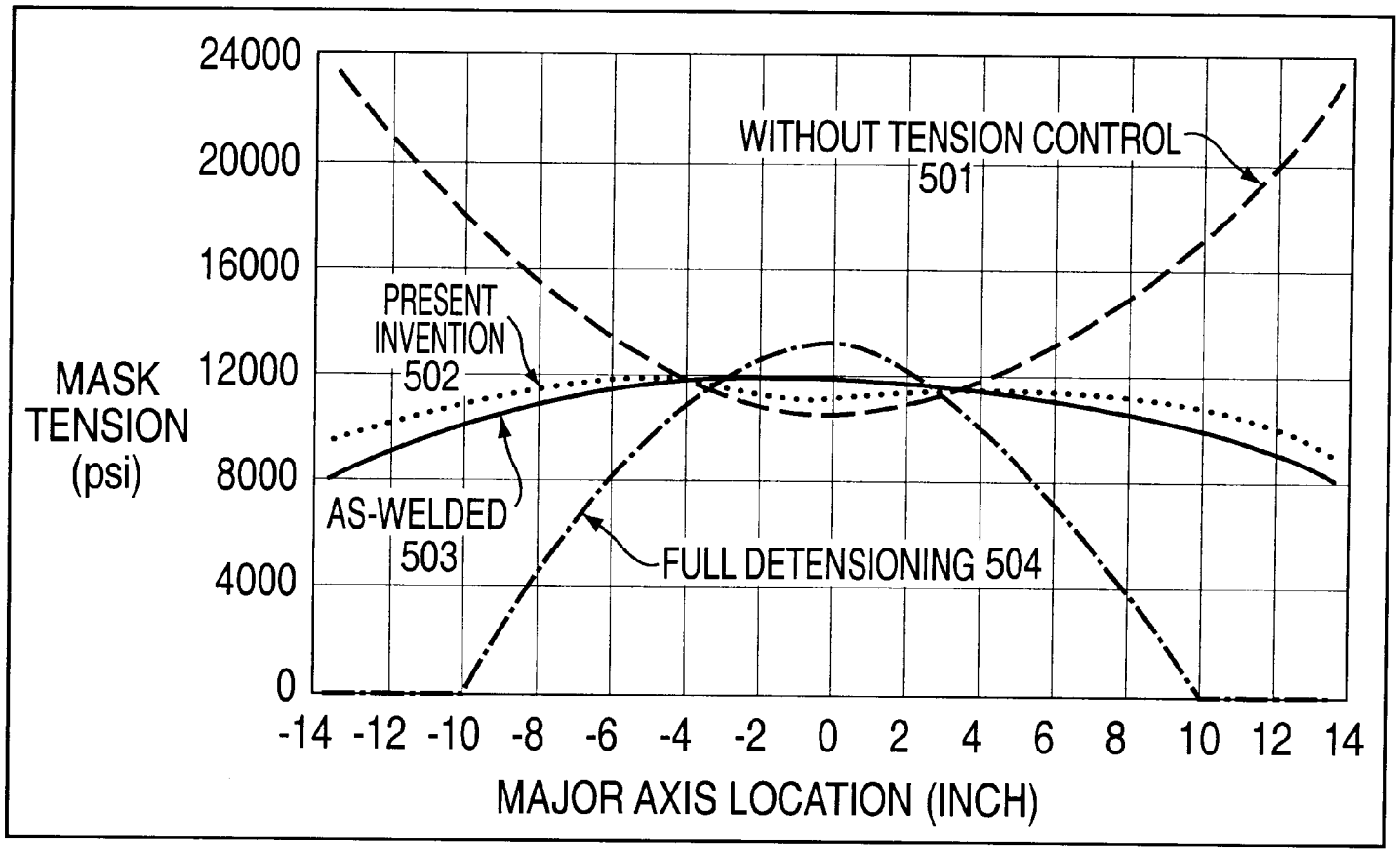
FIG. 4 is a graphically charted diagram showing the operation principal of the invention.

The present invention was developed for tension masks for use in cathode ray tubes having mask frame assemblies composed of a steel mask frame 306 and a low expansion iron nickel alloy metal material, such as INVAR®, tension mask 30. For mask frame assembly 300, there is a large difference in thermal expansion between the tension mask 30 and the mask frame 306. This results in excessive stresses in the tension mask 30 during tube fabrication that will cause tension loss or wrinkles. This condition is shown as line 501 in FIG. 4.

The present invention provides low expansion braces 308 on the mask frame 306 to preserve, through a mechanical system, the tension levels in the tension mask 30 (line 502, FIG. 4) at the original level of tension (line 503, FIG. 4) when the tension mask 30 is welded to the mask frame 306. This type of tension control is preferred over conventional detensioning of the tension mask 30 during thermal processing of the tube. The conventional detensioning (line 504, FIG. 4) produces large gradients in tension in the tension mask 30 during thermal processing that may result in wrinkles caused by differential creep, i.e., non-uniform creep along the mask major axis induces poison effects which left unbalanced, produce wrinkles.

The elements of the mask frame assembly 300 comprise a set of steel hollow frame elements 324 that form the short sides of the mask frame 306 and a set of standoffs 304 attached to each end of each frame element 324. The frame assembly 300 includes two long sides that have triangular shaped cross-section support structures, hereinafter referred to as a triboxes 310. The steel triboxes 310 are formed from steel sheet metal in the shape of a right triangle. A first side (leg) 312 of the tribox 310 is affixed to the standoff 304, now forming a complete rectangular frame, such that the second side (leg) 314 of the triangular triboxes 310 is perpendicular to the mask frame 306. In this manner, the hypotenuse 316 of the triangle faces inward with respect to the frame assembly 300. The triboxes 310 may be affixed to the steel standoffs 304 by, but not limited to, the following methods: seam, laser, spot, tack or resistance welding.

After the triboxes 310 have been affixed to the standoffs 304, a blade 302 composed of a low expansion material, such as INVAR®, is vertically oriented and affixed parallel and adjacent to the second side 314 of the tribox 310. The blade 302 is used as an interface between the mask frame 306 and the tension mask 30. The tension mask 30 shown in FIG. 2 is welded to the top surface 322 of the blade 302, but is not shown in this view for clarity.

A brace 308, made of a low thermal coefficient of expansion material such as INVAR®, is a rectangular strip having a thickness and two respective ends 308A and 308B. One of the ends 308A is affixed to a top surface 325 of the frame element 324. The other end 308B is affixed to the hypotenuse 316 of the tribox 310. The brace 308 may be attached to the tribox 310 and frame element 324 by seam, spot, tack or resistance welding. A total of four braces 308 are employed around the frame to maintain tension of the tension mask 30.

This mask frame assembly 300 functions as follows: during the thermal process where the picture tube is heated during manufacture or operation, the thermal expansion mismatch and geometric separation between the INVAR® brace 308 and the short side steel frame element 324 causes the triboxes 310 to inwardly rotate about the standoff 304 during heating. The braces 308 are sized such that the inward rotation of the triboxes 310 compensates for the expansion of the frame element 324, thereby preserving the as-welded tension in the shadow mask 30. Because the brace 308 compensates for the rotation of the triboxes 310 and the expansion of the mask frame assembly 300 is preserved, the shadow mask 30 maintains its original tension throughout and after heating. That is, the tension has not been reduced before the thermal cycle nor has it been increased after the thermal cycle. The lower linear coefficient of thermal expansion of INVAR® ($1.6\times10^{-6}$/° C.) when compared to low alloy steel ($12.0\times10^{-6}$/° C.) allows small critical parts or areas to be formed of INVAR® and provides a predominantly steel mask frame assembly 300 with the expansion characteristics of an all INVAR® mask frame. This reduces the amount of INVAR® material used during manufacture, thus providing a reduction in total cost.

As the embodiments that incorporate the teachings of the present invention have been shown and described in detail, those skilled in the art can readily devise many other varied embodiments that still incorporate these teachings without departing from the spirit of the invention.

What is claimed is:

1. A cathode ray tube having a mask frame assembly mounted therein in spaced relation to a screen, said mask frame assembly comprising:

a tension mask;

a peripheral frame having at least one peripheral tribox bridging said tension mask to said frame; and at least one brace member having a different coefficient of thermal expansion than said assembly, said at least one brace member being attached between said frame and said peripheral tribox at opposite ends of said at least one peripheral tribox whereby said at least one tribox is caused to flex by the difference in the coefficient of expansion of said at least one brace and said assembly as a result of temperature changes during tube operation.

2. The mask frame assembly of claim 1, wherein said triboxes have a generally triangular shaped cross-section comprising a first vertical side, a second horizontal side attached normal to said first vertical side and a hypotenuse side extending between said first and second sides so as to generally form a triangle.

3. The mask frame assembly of claim 2, further comprising a blade attached to said first side of each of said triboxes for attaching said mask to said triboxes.

4. The mask frame assembly of claim 3, wherein the blade and the at least one brace member have similar coefficients of thermal expansion.

5. The mask frame assembly of claim 1 wherein the at least one brace member has a lower coefficient of thermal expansion than said assembly.

6. A mask frame assembly for a color cathode ray tube having a funnel, an electron gun disposed in a neck portion of said funnel, a panel, and a phosphor screen disposed inside said panel, comprising:

a mask disposed in the vicinity of said phosphor screen;

a substantially rectangular shaped frame defined by opposed pair of first and second sides;

triboxes which are formed along said pair of said first sides, said mask is fixed to said triboxes under a condition that a predetermined tension is applied to said mask; and, at least one brace coupled to each of said triboxes and to each of said second sides of said frame, wherein the coefficient of expansion of said triboxes is different than said brace whereby said triboxes is caused to flex by the expansion of said frame when said mask frame assembly becomes heated during tube operation.

7. The mask frame assembly of claim 6, further comprising a standoff interposed between said triboxes and said pair of first sides.

8. The mask frame assembly of claim 7, wherein the coefficient of expansion for said standoff is similar to the coefficient of expansion of said substantially rectangular shaped frame.

9. The mask frame assembly of claim 6 further comprising at least one blade member extending from said triboxes for fixing said mask to said triboxes.

10. The mask frame assembly of claim 6 wherein the at least one brace member has a lower coefficient of expansion than said rectangular frame.

11. A cathode ray tube having a mask frame assembly mounted therein in spaced relation to a screen, said mask frame assembly comprising:

a tension mask;

a peripheral frame having at least one peripheral tribox bridging said tension mask to said frame; and at least one brace member having a lower coefficient of thermal expansion than said assembly, said at least one brace member being attached between said frame and said peripheral tribox at opposite ends of said at least one peripheral tribox whereby said at least one tribox is caused to flex by the difference in the coefficient of expansion of said at least one brace and said assembly as a result of temperature changes during tube operation.

12. The mask frame assembly of claim 11, wherein said triboxes have a generally triangular shaped cross-section comprising a first vertical side, a second horizontal side attached normal to said first vertical side and a hypotenuse side extending between said first and second sides so as to generally form a triangle.

13. The mask frame assembly of claim 12, further comprising a blade attached to said first side of each of said triboxes for attaching said mask to said triboxes.

14. The mask frame assembly of claim 13, wherein the blade and the at least one brace member have similar coefficients of thermal expansion.

* * * * *